US005829905A

United States Patent [19]

Woodruff

[11] Patent Number: 5,829,905

[45] Date of Patent: Nov. 3, 1998

[54] TRAVEL LIMITER FOR A DYNAMICALLY PIVOTING MULTIPLE ROLLER-BRUSH SPRAY

[75] Inventor: Byron J. Woodruff, Santa Clara, Calif.

[73] Assignee: Paint Trix Inc., Sunnyvale, Calif.

[21] Appl. No.: 854,549

[22] Filed: May 12, 1997

[51] Int. Cl.[6] ..... B43M 11/02

[52] U.S. Cl. ..... 401/219; 401/27; 401/289

[58] Field of Search ..... 401/219, 27, 209, 401/208, 218

[56] References Cited

U.S. PATENT DOCUMENTS

| | | | |
|---|---|---|---|
| 3,015,837 | 1/1962 | Teall | 15/544 |
| 3,915,382 | 10/1975 | Davis | 239/195 |
| 4,140,410 | 2/1979 | Garcia | 401/150 |
| 4,323,196 | 4/1982 | Logue et al. | 239/532 |

FOREIGN PATENT DOCUMENTS

| | | |
|---|---|---|
| 1009-522 | 4/1983 | U.S.S.R. . |

*Primary Examiner*—David J. Walczak
*Attorney, Agent, or Firm*—Thomas Schneck

[57] ABSTRACT

A fluid applicator for surfaces combining a spray-gun and dynamically displacable roller-brushes with a moveable travel limiter selectively adjusts the maximum rotational displacement of the roller-brushes to prevent the same traveling across the path of a fluid spray being emitted from the spray-gun. The angle of a fluid stream exiting the nozzle is allowed to vary with respect to the longitudinal axis of the roller-brushes to more accurately control over-spray, especially with surfaces in close proximity with one another.

21 Claims, 8 Drawing Sheets

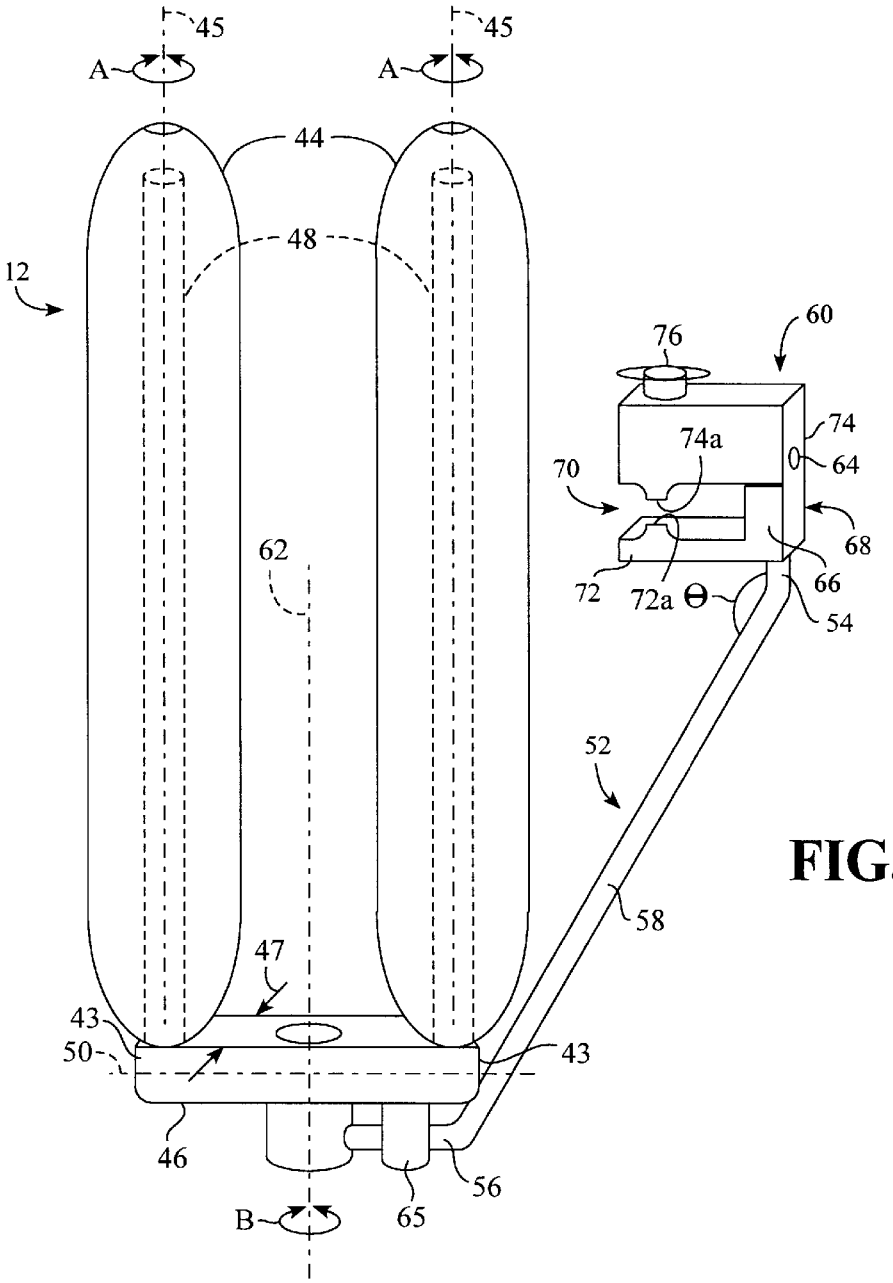
FIG. 3
FIG. 4
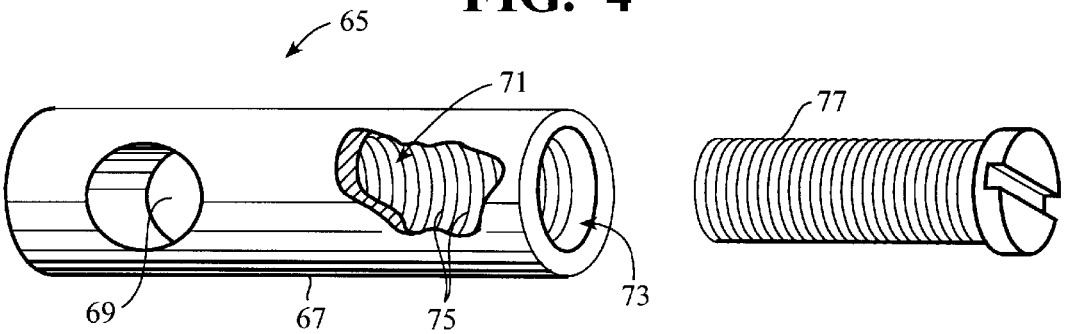

TRAVEL LIMITER FOR A DYNAMICALLY PIVOTING MULTIPLE ROLLER-BRUSH SPRAY

TECHNICAL FIELD

The present invention relates to an apparatus for simultaneously spraying and rolling fluid onto surfaces.

BACKGROUND ART

Various applicators may be employed to deposit fluid, such as paint, onto a surface, e.g. bristle-brushes, roller-brushes and high and low pressure spray-guns. The choice of applicator is typically dependent upon the texture of the surface to which the paint will be deposited. For example, traditional bristle-brush applicators, of the type having a plurality of bristles extending parallel to an axis of a handle, have been found particularly useful for depositing paint onto surfaces having a rough texture, which include recesses. A problem with the traditional bristle-brush is that the paint, to be deposited on a surface, is kept in a reservoir which is remotely disposed with respect to the surface. This results in a great amount of time being consumed moving the bristle-brush between the reservoir and the surface. Movement between the surface and the reservoir also increases the probability that paint may drip from the bristles which increases the quantity of paint required to complete a particular project, thereby reducing the transfer efficiency of the bristle-brush. Also, the paint is often placed on the surface in a non-uniform manner, being thicker in areas where the bristle-brush is first applied thereto. Thus, many strokes are required to spread the paint evenly on the surface.

To reduce the time necessary to deposit paint on a surface, the roller-brush was developed. Although the roller-brush decreases the time necessary to deposit paint, the reservoir of paint is still remotely disposed with respect to the surface. This results in many of the drawbacks associated with the traditional bristle-brushes, including a relatively poor transfer efficiency. In addition, roller-brushes are not particularly suited for surfaces with rough textures, because it is difficult for the roller-brush to deposit liquid in deep recesses associated therewith.

The inner feed pressure roller-brush addresses the problem of remotely disposing a paint reservoir from a surface to be covered with paint. Titan Tool, Inc. describes, in a sales brochure, an inner feed pressure roller-brush including an auger rotatably disposed with respect to a hollow frame, with the roller-brush fitting over the auger. The auger includes a plurality of orifices in fluid communication with the hollow frame. Paint flows through the hollow frame and egresses from the plurality of orifices. The auger rotates through the length of the roller-brush to distribute the paint along the inner roller surface. The inner roller surface is sufficiently porous to allow the paint to flow to the external surface of the roller-brush. A drawback with this device is that it is subject to premature failure due to clogging of the orifices and the roller-brush. The clogging causes an uneven distribution of paint observed as a polka-dot pattern. This requires many passes of the roller over the same area to provide a uniform paint distribution. In addition, the roller-brush suffers from the inherent problem of being unsuitable to deposit paint in the recesses of rough or textured surfaces.

Spray-guns are well known in the art and overcome many of the aforementioned drawbacks associated with brush applicators. Traditionally, there are two designs for spray-guns. One design employs pressurized air to atomize liquid producing a plurality of atomized liquid particles exiting a nozzle, with the nozzle positioned proximate to a surface on which the liquid is to be deposited. The other design of spray-guns forms a high-pressure fluid stream without air-flow assistance. In this manner, a high pressure stream reaches the nozzle, with the nozzle designed to disperse the stream, forming, on the surface, a fluid envelope of desired geometry. This provides an improved transfer efficiency, typically 65%, as compared with the air-flow assisted spray-guns, which is typically 40%. In both of the aforementioned designs, the nozzle of the spray gun is remotely disposed with respect to a reservoir storing the liquid. The nozzle and the reservoir are kept in fluid communication via high pressure conduits.

Drawbacks associated with the spray-guns is that high pressure liquids impinging upon a surface often "bounce-back", creating "over-spray" which speckles objects located in the environs about the surface to be coated. This reduces transfer efficiency, with the transfer efficiency of the air-atomization spray-gun being worsened by the ease with which atomized liquid is carried by wind. In addition, obtaining a uniform coating on a surface is often difficult, because inexperienced and undertrained users of a spray-gun tend to move the spray-gun in a arcuate pattern with respect to the plane of the surface being coated. Finally, the bounce-back phenomenon makes spray-guns unsuitable for close proximity spraying.

Titan Tool, Inc. describes, in a sales brochure, a combination roller-brush and spray-gun in which a single roller, having a longitudinal axis, is disposed spaced-apart from a spray nozzle. The nozzle produces a liquid stream extending tangentially upon the circumference of the roller, along the entire longitudinal axis. To deposit liquid upon a surface, the combination is moved so that the spray-gun deposits the liquid onto the surface with the roller-brush following the spray-gun to uniformly spread the liquid across the surface. A drawback with the Titan roller-brush and spray-gun combination is that it may be used in only one direction, thereby precluding one continuous motion for depositing liquid upon a surface. In addition, the distance between the nozzle and the surface is not fixed, resulting in a stripe having a variable width being deposited upon a surface, as shown in FIG. 1. Both of these drawbacks increase the time necessary to cover a given area of a surface. In addition, the transfer efficiency is greatly reduced due to the significant overlapping of adjacent stripes necessitated to cover an entire surface, shown as 11. The transfer efficiency of the Titan Tool, Inc. device is typically around 65%. In addition, the liquid envelope produced by the nozzle must be sufficiently narrow to avoid impinging upon the roller-brush, which would result in a great amount of over-spray being created. This reduces the area of the surface being sprayed, also increasing the time necessary to cover a given surface. Finally, with the nozzle and the roller-brush are in fixed orientation with respect to each other, the combination is unsuitable for depositing liquid upon surfaces in close proximity with each other.

Soviet Pat. No. SU 1009-522 discloses a paint roller including a frame, one end of which is attached proximate to a nozzle of a paint gun, with the opposing end having a cross-member attached thereto. The cross-member is pivotally mounted to the frame to rotate about an axis. A pair of spaced-apart roller-brushes are attached to the cross-member so that the roller-brushes are disposed at opposite ends thereof. Paint is described as being supplied under pressure so as to exit from the nozzle and impinge upon one of the paint rollers, which will contribute to bounce-back.

U.S. Pat. No. 3,015,837 to Teall discloses a combination roller-brush and low pressure air-atomization spray-gun in which two spaced-apart rollers are attached to a frame and positioned on opposite sides of a plurality of nozzles. Although the nozzles of the Teall invention provide a wider spray envelope than the Titan Tool, Inc. device, the nozzles are maintained in an optimal position with respect to the rollers so that the nozzles are surrounded by the rollers and the frame. In this manner, over-spray is substantially reduced and may be obviated altogether by placing a resilient shield over the rollers and the nozzles, making it difficult to observe the area of the surface to which liquid is being deposited. However, bounce-back is still prevalent due to the close proximity between the surface and the nozzle, which results in a poor transfer efficiency. In addition, with the nozzle and the roller-brushes being in fixed orientation with respect to each other, the combination is unsuitable for depositing paint upon surfaces in close proximity with one another. Another drawback with the Teall device is that it is rather large and cumbersome, making it difficult for a user to hold and use for long periods of time. Also, roller replacement and cleaning are difficult.

U.S. Pat. No. 3,915,382 to Davis discloses an extension spray gun having a telescopically extendable pole with a spray nozzle secured to one end thereof. A spray gun is attached to the opposing end, and a flexible hose is connected between the nozzle and the spray gun. A portion of the flexible hose is described as extending through the pole and slidably engaged therewith. One end of the flexible hose is fixedly attached to a control valve, and an opposing end is fixedly attached to the spray nozzle.

U.S. Pat. No. 4,140,410 to Garcia discloses a paint roller applicator attached to an elongated handle and an arcuate nozzle that extends adjacent to the roller. The nozzle is positioned to discharge paint onto the roller, which may cause bounce-back.

U.S. Pat. No. 4,323,196 to Logue et al. discloses a paint spraying apparatus that includes an elongated tube having a nozzle pivotally mounted to one end thereof. A handle is mounted to an opposing end of the tube and operates a valve which controls the flow of fluid through the tube. Coupled to the tube between the handle and the nozzle is a pivotal grip. The pivotal grip is connected to the nozzle via a cable and pulley system. In this fashion, the nozzle my be remotely rotated by moving the grip; however, there is no shielding provided to prevent bounce-back.

What is needed is a relatively light-weight liquid applicator that allows depositing liquid upon a surface in one continuous motion while avoiding overspray from depositing upon the environs associated with the area to receive liquid.

SUMMARY OF THE INVENTION

A roller-brush applicator combining a spray-gun and a dynamically displacable cross-member having roller-brushes mounted thereto features a moveable travel limiter to selectively adjust the maximum rotational displacement of the cross-member to prevent the roller-brushes from traveling across the flow path of a fluid spray being emitted from the spray-gun. With this design, the liquid transfer efficiency of the applicator, from the nozzle to a surface, is nearly 90%. The roller-brush applicator includes a frame having first and second opposed ends, with a connecting means, attached to the first end, for attaching the frame proximate to the nozzle, and a cross member pivotally mounted to the second end to rotate about a pivot axis. A pair of spaced-apart roller-brushes are each rotatably mounted to a shaft, with the shafts extending from the cross-member.

The shafts extend parallel to, and are disposed on opposite sides of, the pivot axis. The cross-member traverses an arcuate path, and the travel limiter is mounted to the frame so as to extend across the arcuate path and contact the cross-member upon the cross-member reaching extreme angles of rotation. In this fashion, a maximum rotational movement of the cross-member is established. Typically, the detent is spaced-apart from the pivot axis and is slidably engaged with the frame. This allows varying the distance between the pivot axis and the detent, thereby varying the maximum rotational movement of the cross-member.

BRIEF DESCRIPTION OF THE DRAWINGS

FIG. 3 is a perspective view of the apparatus shown in FIG. 2, without the spray-gun, for purposes of clarity.

FIG. 4 is a perspective view of a travel limiter shown is FIG. 2.

BEST MODE FOR CARRYING OUT THE INVENTION

Figure 1:
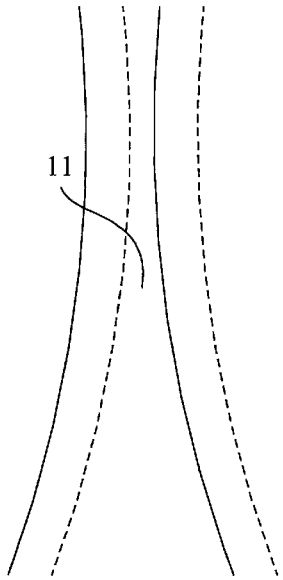
FIG. 1 (Prior Art)
FIG. 1 is a plan view showing stripe patterns of paint deposited upon a surface using a device of the prior art.
Figure 2:
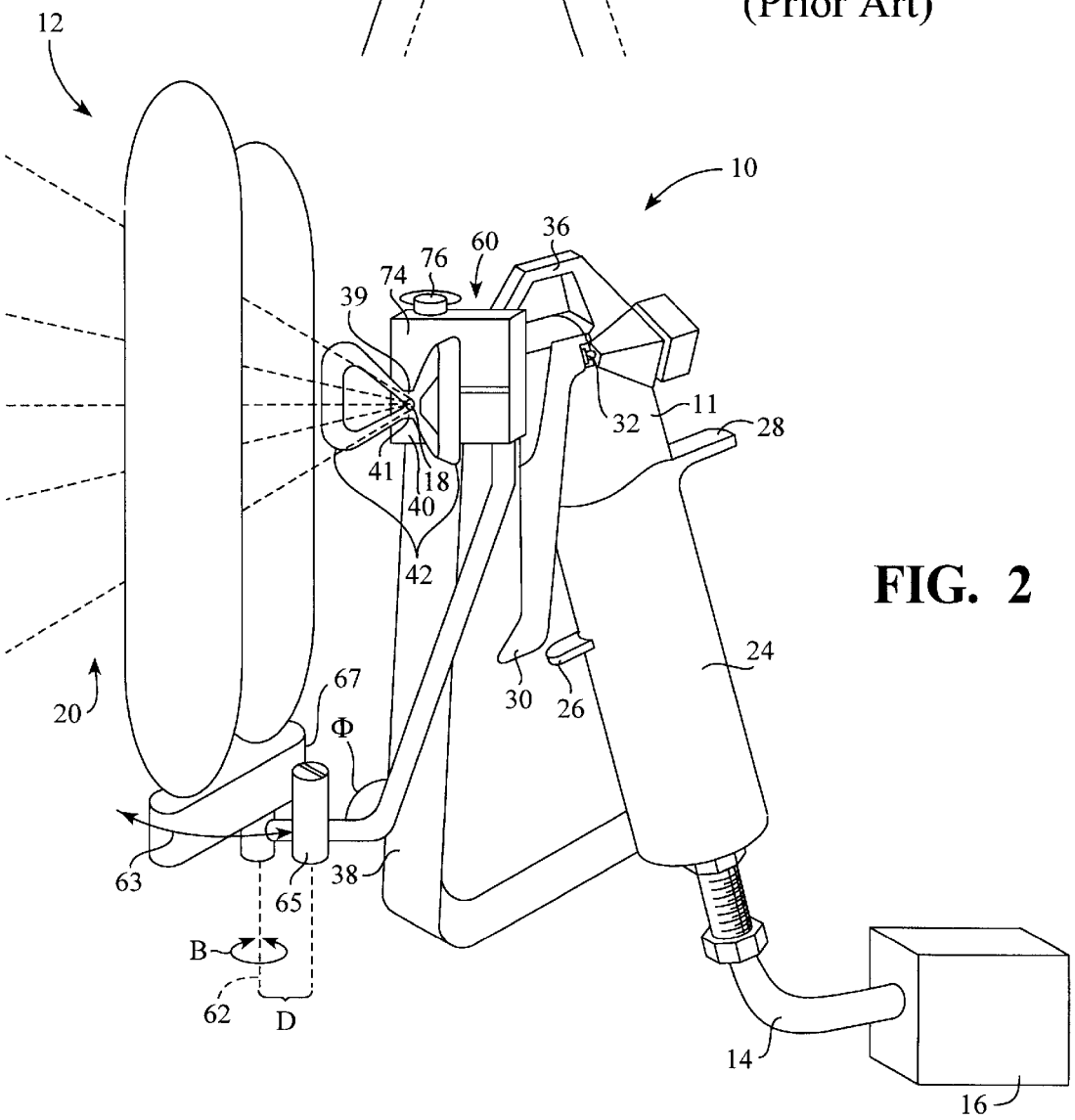
FIG. 2 is a perspective view of a first embodiment of the present invention.

With reference to FIG. 2, the apparatus of the present invention features a hand-held fluid spray-gun 10 in combination with a roller-brush applicator 12 disposed in front of the manifold body 11. Attached to the body 11 from below is an inlet conduit 14 which is in fluid communication with a pressurized source of fluid 16. A nozzle 18 is attached to an opposite end of the body 11, proximate to an outlet, not shown. The nozzle 18 allows a spray of fluid 20 exiting from the outlet to travel toward the roller-brush applicator 12. The body 11 has a grip 24 to facilitate holding the gun 10 by a hand of an operator (not shown) with the grip having a front projection 26 and a rear projection 28 which provide support for the hand holding the gun 10. Disposed above the front projection 26 is a trigger 30 in a position for operation by an index finger of an operator while other fingers of the operator hold the grip 24 below the front projection 26.

The trigger 30 is resiliently disposed to be held away from the grip 24. When moved inwardly toward the grip 24, the trigger 30 actuates a push rod 32, which in turn opens a valve, not shown. The valve controls whether the pressurized fluid can flow through the gun 10 and selectively places the inlet conduit 14 and the outlet in fluid communication. With the trigger 30 moved inwardly, the valve is opened, and the spray of fluid 20 shoots from the nozzle 18. To protect the spray-gun 10 from damage, a top guard 36 projects from a top end. A metal wire 38, or like material, extends between the nozzle 18 and the grip 24, projecting forward thereof to surround the trigger 30 and provide protection for a hand holding the gun 10. A nozzle guard is positioned proximate to the nozzle 18 and includes a body 40 and a pair of projections 42. Each projection 42 is a hollow trapezoid. The projections 42 extend from the body and are symmetrically disposed on, and angled away from, opposite sides of the nozzle 18, with the portion of the projections 42 proximate to the nozzle 18 forming upper 39 and lower 41 notches. The nozzle guard serves to protect a user from the fluid spray 20, while allowing the fluid spray 20 to pass unobstructed.

Referring also to FIG. 3, the roller-brush applicator 12 includes two roller-brush members 44, disposed on opposite ends of a cross-member 46. Any type of roller-brush may be employed. A shaft 48 is disposed at each end 43 of the cross-member 46, shown as dashed lines, with a roller-brush member 44 rotatably disposed thereon. Each shaft 48 extends along the same direction, perpendicular to the longitudinal axis 50 of the cross-member 46. The roller-brush members 44 may rotate in the direction shown by arrows A.

Referring to both FIGS. 2 and 3, a frame 52 comprises a single rod and includes first 54, second 56 and third 58 portions which extend parallel to a common plane. A clamp 60 is attached to the first portion 54 and is discussed more fully below. The first portion 54 extends from the clamp 60, terminating in the third portion 58 and forming an oblique angle θ therewith. The third portion 58 extends from the first portion 54, terminating in the second portion 56, forming an oblique angle Φ therewith, with the absolute value of the difference between angles Φ and θ approximating 90°. The cross-member 46 is pivotally mounted to the end of the second portion 56, opposite to angle Φ, to traverse about a pivot axis 62 along an arcuate path 63. The pivot axis 62 extends parallel to shafts 48, with the shafts 48 and the pivot axis 62 typically lying in a common plane. In this manner, it can be said that the longitudinal axis 45 of the roller-brush members 44 extend parallel to the pivot axis 62. It is preferred that the roller-brush members 44 be symmetrically disposed on opposite sides of the pivot axis 62, with the pivot axis allowing the cross-member 46 to rotate in the directions indicated by arrow B.

The width 47 of the cross-member 46 is measured parallel to the longitudinal axis 50 thereof. To limit the rotational movement of the cross-member 46, a travel limiter, in the way of a detent 65, is mounted to the frame 52 so as to extend across the arcuate path 63, with the width 47 of the cross-member 46 being sufficiently wide to contact the detent 65 when rotated to an extreme angle about pivot axis 62. In this fashion, the spray 20 is prevented from impinging upon the roller-brushes 44. Typically, the detent 65 is spaced-apart from the pivot axis 62, a distance D, and is slidably engaged with the second portion 56 of the frame 52. The amount of rotational movement that the cross-member 46 may undergo is directly proportional to the distance D. By having the detent 65 slidably engaged with the frame 52, the distance D and, therefore, the maximum rotational movement of the cross-member 46, may be varied. To fix the relative position of the detent 65 with the second portion 56, a locking mechanism is provided.

As shown in FIG. 4, the detent 65 includes an elongated body 67 that includes a throughway 69 disposed proximate to one end. The throughway 69 is of sufficient size to allow the second portion 56 to pass therethrough, shown more clearly in FIG. 2. Referring to FIGS. 2, 3 and 4, the elongated body 67 has a chamber 71, one end of which extends from the throughway 69, terminating in an opening 73. The aforementioned locking mechanism consists of a plurality of threads 75 formed on the interior surface of the chamber 71 and a screw 77 adapted to engage the threads 75. Upon reaching a final seating position, one end of the screw 77 enters the throughway 69 wedging against the second portion 56. In this fashion, the distance D may be selectively fixed to establish a preset maximum rotational movement of the cross-member 46 along the arcuate path 63, with both the cross-member 46 and the detent 65 functioning as a stop.

As shown in FIG. 3, one embodiment of the clamp 60 includes a body 64 having first 66 and second 68 opposed major surfaces, with a recess 70 disposed therein, forming a fixed jaw 72. A moveable jaw 74 is disposed opposite to the fixed jaw 72 and includes a lever 76 to secure the position of the moveable jaw 74 with respect to the fixed jaw 72. The fixed jaw includes a tooth **72*a* positioned proximate to the first surface, extending toward the movable jaw 74. Movable jaw 74 includes a tooth 74*a* extending therefrom toward tooth 72*a* and in opposing relation therewith. The clamp 60 is positioned on the first portion 54 of the frame 52 so that the normal to the first major surface extends perpendicular toward the pivot axis 62. The recess 70 receives the body 40 of the nozzle guard, and the lever 76 is adjusted so that the body 40 is wedged between the fixed 72 and moveable 74 jaws, shown more clearly in FIG. 2. Referring to both FIGS. 2 and 3, teeth 72*a* and 74*a* are received with the upper 39 and lower 41 notches, respectively. In this manner, the teeth 72*a* and 74*a* form an interlocking fit with notches 39 and 41 to securely affix applicator 12 to the spray-gun 10. In this position, the nozzle 18 is aligned to face the pivot axis 62**.

Figure 5:
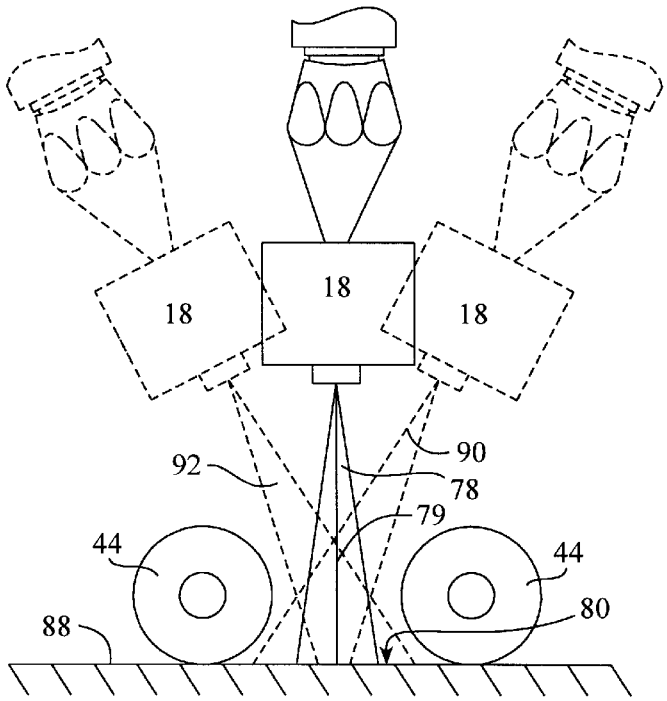
FIG. 5 is a top view of the apparatus shown in FIG. 2, demonstrating the path of a fluid stream compared to a spatial displacement of the roller-brushes with respect to a nozzle.
Figure 6:
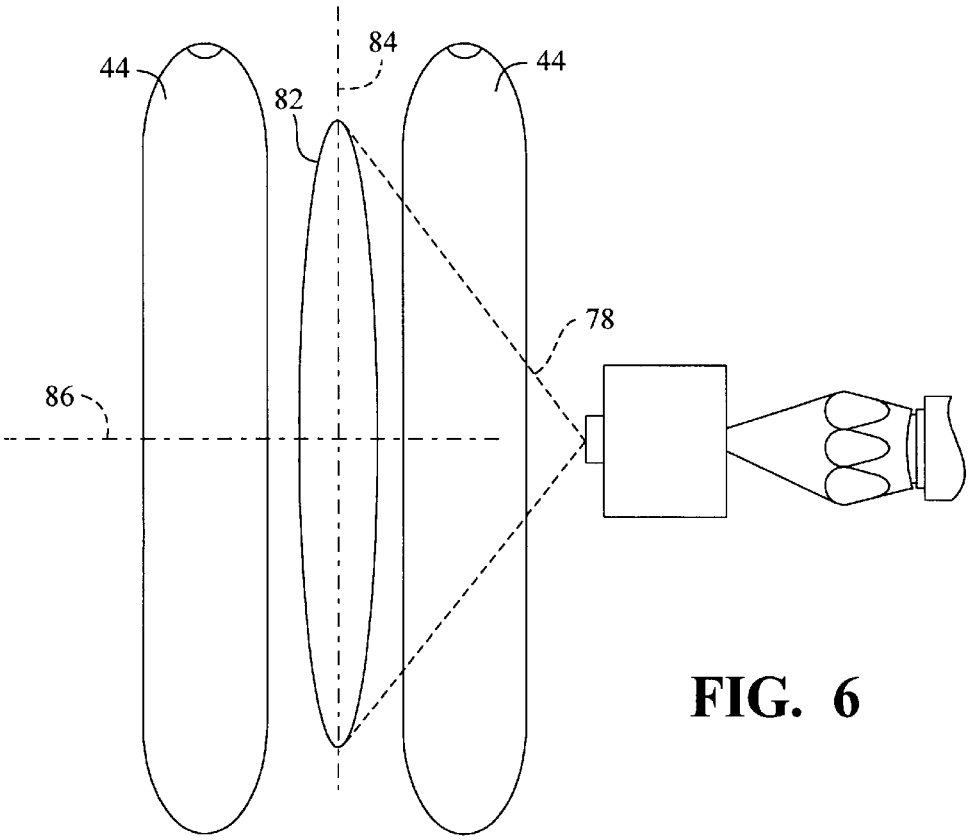
FIG. 6 is plan view showing a spray envelope produced by the nozzle of the apparatus shown in FIG. 4, in accord with the present invention.

Referring also to FIGS. 5 and 6, fluid 20 exiting the nozzle 18 creates a fluid stream 78 having a predetermined geometry that impinges upon a target plane 80, which is generally defined between roller-brush members 44. The fluid stream 78 traverses a flow path 79 defined by the nozzle 18 and fans-out in two directions, forming a fluid envelope 82 upon reaching the target plane 80. The shape and size of the fluid envelope 82 is dependent upon the nozzle 18 employed and the distance between the target plane 80 and the nozzle 18. Although any shape envelope may be formed, the preferred shape of the fluid envelope 82 is that of an ellipsis with the major axis 84 typically extending coextensive with the length of the roller-brushes 44. The minor axis 86 is typically centered along the length of the roller-brushes 44.

In operation, the invention may be used to apply any liquid, e.g., paint, adhesives and the like, to any surface and will be discussed with respect to depositing paint on a wall. The roller-brush members 44 are firmly pressed against the wall 88 that is to receive a coat of paint. The target plane 80 is typically a portion of the wall 88 located between roller-brush members 44. As the spray-gun 10 moves back and forth over the wall, the nozzle 18 distributes the paint in the shape of the flow envelope 82. The roller-brush members 44 spread the paint deposited in the flow envelope 82, over the wall, into a uniform coat. It is apparent that only one roller-brush member 44 spreads the flow envelope 82 at any given time, i.e., the roller-brush member 44 following the nozzle 18 in the direction the spray-gun 10 moves. As the spray-gun 10 moves back-and-forth on the wall 88, the cross-member 46 is allowed to rotate about pivot axis 62. The longitudinal axis 45, of the roller-brush members 44, is displaced with respect to the nozzle 18, and the fluid stream 78, allowing one roller-brush member 44 to move closer thereto, and one further therefrom, while the distance between the target plane 80 and the nozzle 18 remains fixed. This allows the distance between the nozzle 18 and the target plane 80 to be independent of the rotational position of cross-member 46 about axis 62. In this manner, one of the roller-brush members 44 may be positioned so that the fluid stream passes tangentially thereto, shown as fluid streams 90 and 92, which traps the paint thereunder, acting as a shield to prevent over-spray from depositing on the environs about the wall 88. This is particularly useful in that a wall to be painted often terminates adjacent to an object which may be advantageous to shield against paint spray, e.g. a baseboard or a ceiling.

Figures 7, 8:
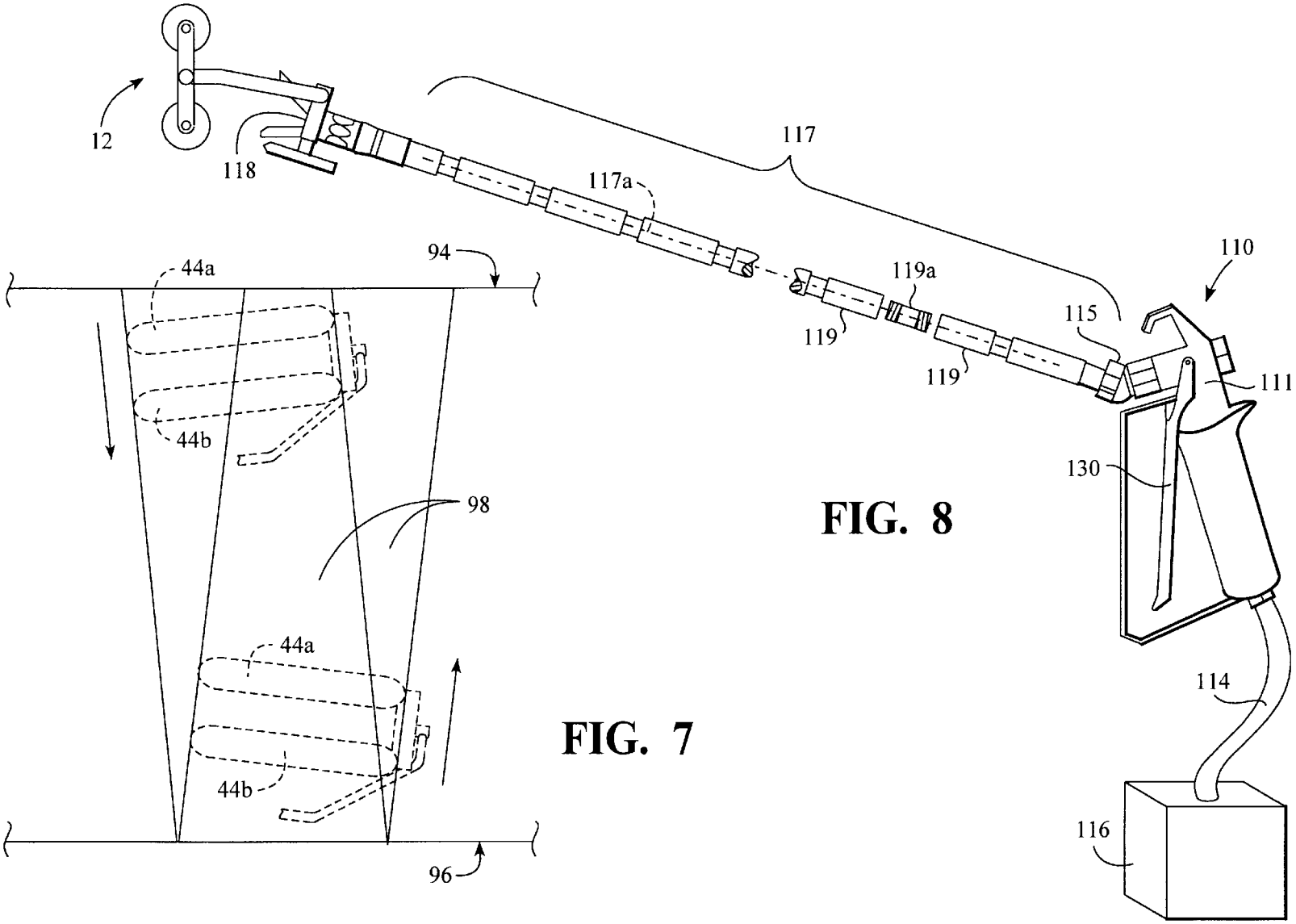
FIG. 7 is a plan view showing stripe patterns of paint deposited upon a surface using an apparatus in accord with the present invention.
FIG. 8 is a side view of an alternate embodiment of the apparatus of the present invention.

For example, as shown in FIG. 7, the wall terminates between a ceiling 94 and floor 96. The preferred method of covering the wall with paint is to apply paint by moving the spray-gun in one motion, e.g., from ceiling 94 to floor 96. With the nozzle 18 positioned proximate to the ceiling 94, the fluid stream 78 passes tangentially to the top roller-brush member 44*a*, with a portion of the spray landing on the wall lying beneath member 44*a*. This prevents paint from impinging upon ceiling 94. In a similar instance, the bottom roller-brush member 44*b* prevents paint from depositing on the floor 96. A further advantage with having two roller-brush members 44 is that wall 88 may be covered in one continuous motion, shown as strips 98. As can be seen in FIG. 7, there is slight overlap among the strips to ensure the wall is completely covered. By maintaining a fixed distance between the nozzle 18 and the target area 82, the width of each strip 98 is made uniform, allowing for a more even distribution of the paint. To further facilitate an even distribution of paint, the frame is formed from a resilient material, such as aluminum or a polymer compound, so that the nozzle 18 is not subjected to the vibration and pounding of moving the roller-brush members 44 across the wall 88. With the nozzle 18 separate from the pivoting applicator 12, flexible hoses are obviated, thereby reducing the effort necessary to use the spray-gun 10.

Referring to FIG. 8, another embodiment of the spray-gun 110 is shown, with an inlet conduit 114 attached to one end of the manifold body 111. Conduit 114 is in fluid communication with a pressurized source of fluid 116. Disposed at the opposite end of the body 111 is an outlet 115 which is selectively placed in flow communication with the inlet conduit 114 by the trigger 130 and valve (not shown) assembly as discussed above with respect to FIG. 2. Disposed between the outlet 115 and a nozzle 118 is an elongated wand 117. The wand 117 allows the nozzle 118 to be remotely disposed with respect to manifold body 111 of the spray-gun 110. The nozzle 118 and the brush applicator 12 are structured and attached as discussed above with respect to FIGS. 2 through 6. The primary difference in this embodiment is that the wand 117 facilitates painting areas that would otherwise be beyond the reach of an unaided user. This enables a user to cover larger areas with less physical exertion.

Figure 9:
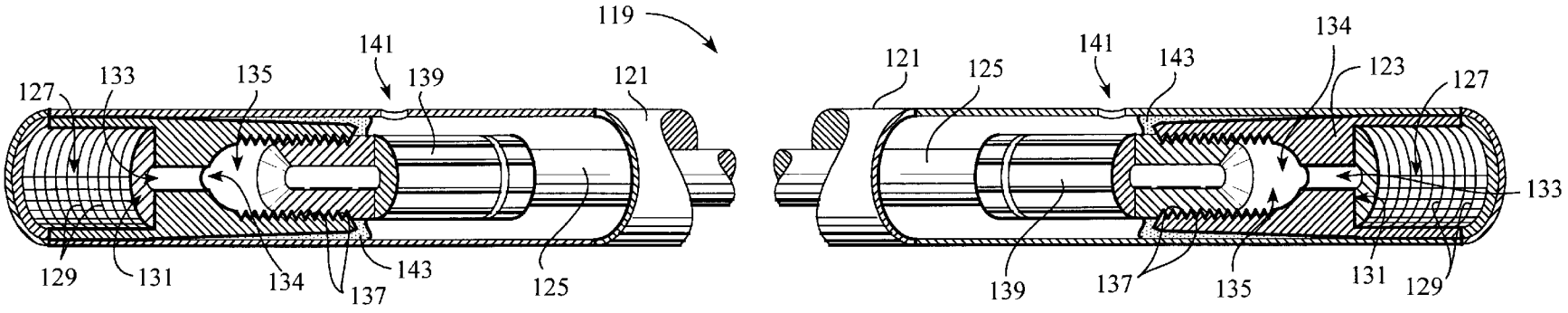
FIG. 9 is a perspective cross-sectional view of an extension wand shown in FIG. 8.

Although any type of wand may be employed, preferably the wand 117 consists of a plurality of coupled together segments 119, one of which is shown in FIG. 9. The segments 119 may be of any length, but preferably are approximately two feet long. The segment 119 includes a hollow, but rigid, tubular body 121 made from any suitable material, e.g., aluminum, nylon, carbon fiber, etc. A coupler 123 is connected at each end of the tubular body 121. Extending between each coupler 123 is a flexible fluid passage 125 which typically comprises of a high pressure fluid hose capable withstanding 4,000 psi. Each coupler 123 includes a large bore region 127 having a diameter of ⅞" and includes a plurality of threads 129. The large bore region 127 extends from one end of the tubular body 121 and terminates in a planar surface 131 having a centrally located throughway 133. The throughway 133 extends from the planar surface 131 terminating in a frusto-conical surface 134 that flares outwardly away from the large bore region 127, terminating in a small bore region 135. The small bore region 135 has a diameter measuring ½ inch and includes a plurality of threads 137. The flexible fluid passage 125 is a conventional type having a threaded attachment 139. The threads 137 of the small bore region 135 are adapted to engage the threaded attachment 139 and form a fluid-tight seal therewith.

To prevent the flexible fluid passage 125 from decoupling from small bore region 135, an aperture 141 is formed into the tubular body 121. A suitable adhesive 143, such as epoxy, is inserted through the aperture 141. The outside surface of the coupler 123 is tapered proximate to the small bore region 135 so that a void is present between the coupler 123 and the tubular body 121. In this fashion, the adhesive 143 fills the void and secures the coupler 123, as well as the flexible fluid passage 125, to the tubular body 121. Two segments 119 are coupled together using a suitable barrel 119*a* having opposed threaded regions adapted to engage the large bore region 127, shown more clearly in FIG. 8.

Figure 10:
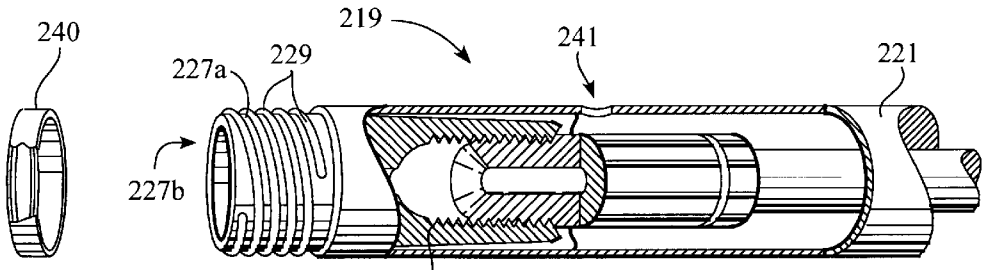
FIG. 10 is a partial perspective cross-sectional view of the extension wand shown in FIG. 9, in accord with an alternate embodiment.

Referring to FIGS. 9 and 10, an alternative embodiment for each segment 219 includes a coupler 123 attached at one end of the tubular body 221, with the opposing end having coupler 223. Coupler 223 is identical to coupler 123 in every respect except that the large bore region 227 of coupler 223 includes a cylindrical body 227*a* that extends from the tubular body 221, ending in a termini 227*b*. The cylindrical body 227 includes a plurality of threads 229 which are adapted to engage the threads 129 of the large bore region 127. In a final seating position, the termini 227*b* seats against the planar surface 131. To maintain a fluid-tight seal therebetween, a compressible washer 240 is disposed against the planar surface 131.

Figure 11:
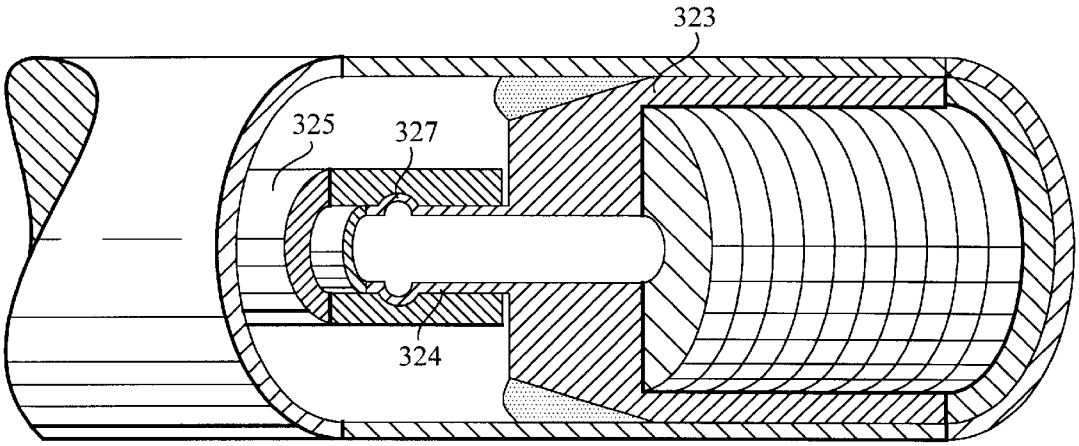
FIG. 11 is a partial perspective cross-sectional view of the extension wand shown in FIG. 9, in accord with an alternate embodiment.

Referring to FIGS. 8 and 11, to reduce the weight of the wand 117 further, each coupler 323 may be formed with a cylindrical protrusion 324 that is adapted to slidably engage the flexible fluid passage 325 and form a fluid-tight seal therewith. In this fashion, the threaded attachments, discussed above with respect to FIG. 9 and which is typically formed from a metal, may be abrogated. The cylindrical protrusion may include a surface feature 327 to securely affix the coupler 323 to the flexible fluid passage 325.

Figure 12:
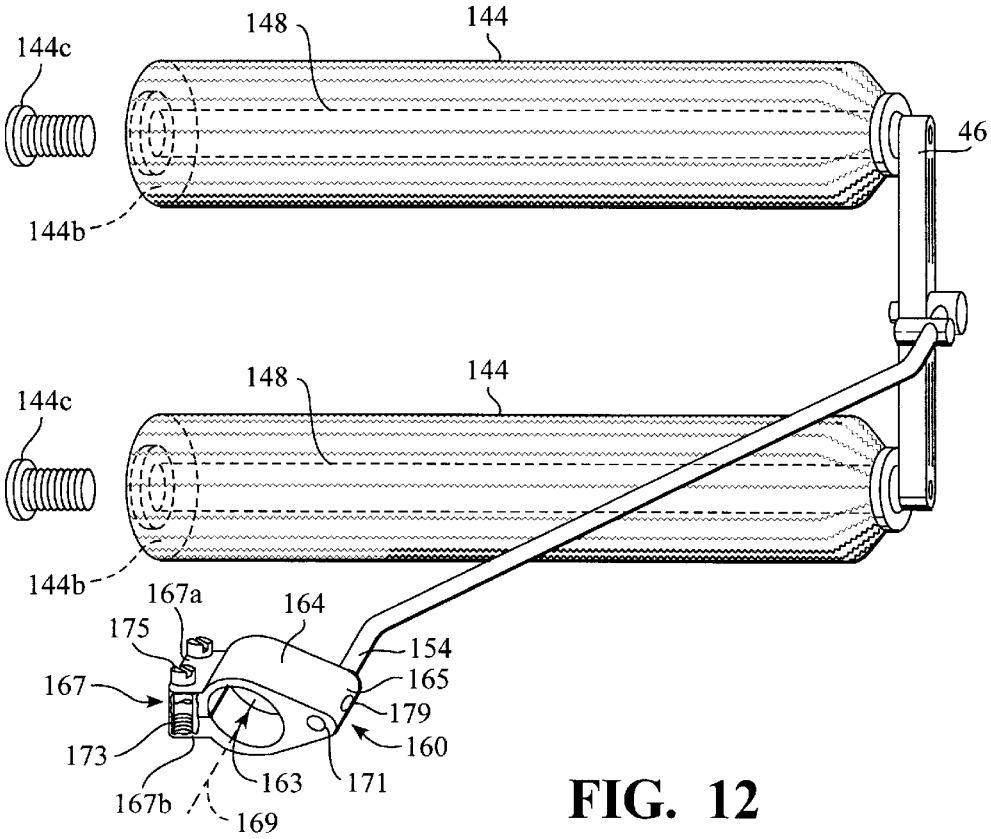
FIG. 12 is a perspective view of the apparatus shown in FIG. 3, in accord with an alternate embodiment.

Referring to FIGS. 8 and 12, an alternate embodiment of the clamp 160 is shown as including a body 164 having a cylindrical bore 163, a solid bulwark 165 and a bifurcated bulwark 167. The bore 163 extends along a longitudinal axis 169, with the solid bulwark 165 and the bifurcated bulwark 167 disposed on opposite sides of the bore 163's diameter. The bifurcated bulwark 167 includes a bore section 167*a* and a threaded section 167*b*. The bore section 167*a* includes at least one through hole 171. The threaded section 167*b* includes at least one threaded hole 173 which is axially aligned with the through hole 171. The diameter of the through hole 171 is larger than the diameter of the threaded hole 173 so that a screw 175 adapted to threadably engage the threaded hole 173, passes through the through hole 171. In this fashion, a head of the screw 175 presses the bore section 167*a* against the threaded section 167*b,* constricting the size of the bore 163 and securing the clamp 160 to the wand 117, shown more clearly in FIG. 13.

A button 144*b,* formed of any suitable lightweight material, is attached at opposing ends of each roller-brush 144. Typically, the button 144*b* is held in place by a screw 144*c* passed through the center thereof and threadably engaging the shaft 148. It is preferred that the buttons 144*b* and the cross-member 46 be made from nylon or some other polymer-based material. In this fashion, the mass of the roller-brush applicator 112 is reduced.

Figure 13:
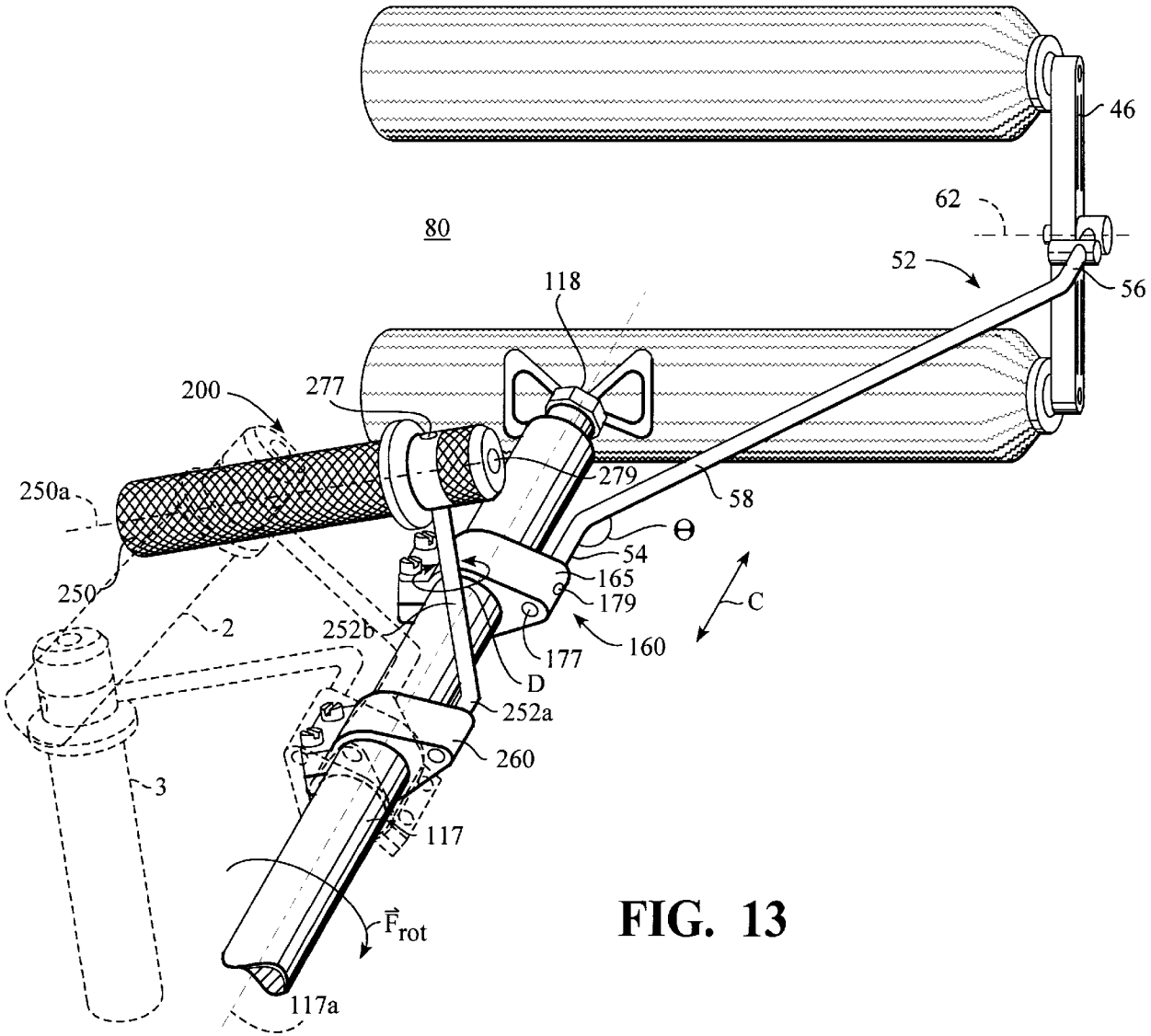
FIG. 13 is a perspective view of the apparatus, shown in FIG. 12, attached to the embodiment shown in FIG. 8 and including a forwardly mounted handle.

As shown in FIG. 13, the frame 52 is connected to the solid bulwark 165 in any conventional manner. In the disclosed embodiment, the solid bulwark 165 includes a recess 177 that extends parallel to the wand 117. The cross-section of the recess is complementary to the cross-section of the first portion 54, which is disposed therein. The first section 54 is retained within the recess 177 by a locking screw 179 extending through the solid bulwark 165, transverse to the recess 177. The frame 52 is orientated so that the first section 54 extends parallel to the centerline 117*a* of the wand 117, with the third portion 58 extending away therefrom at the oblique angle θ. The locking screw 179 seats against the first portion 54, wedging the same against the interior of the recess 177. An advantage with the clamp 160 is that it may be attached any where along the length, shown in direction C, of the wand 117. This allows the distance between the nozzle 118 and the target plane 80 to be varied, which allows varying the size of the flow envelope, as discussed above. This is particularly useful when the width of the cross-member 46 may be varied, discussed more fully below with respect to FIG. 14.

Referring to FIGS. 8 and 13, to reduce fatigue when using the wand 117, a handle 200 may be disposed between the outlet 115 and the nozzle 118. The handle 200 includes a clamp 260, which is identical to clamp 60, excepting that the recess 277 has a first portion 252*a* of an L-shaped rod disposed therein. The second portion 252*b* of the L-shaped rod extends from the first portion 252*a,* transverse thereto and away from the wand 117. A grip portion 250, having a circular cross-section, extends along a longitudinal axis 250*a* from the second portion 252*b.* The grip portion 250 includes a cylindrical recess 277 in which the second portion 252*b* is fitted. A threaded bore 279 extends from the recess 277 and parallel to the longitudinal axis 250*a,* terminating in an opening. A locking screw (not shown) may be disposed with the threaded bore 279 seating against the second portion 252*b,* securely fastening the grip portion 250 thereto. An advantage provided by the handle 200 is that it may be attached any where along the length, shown as direction C, of the wand 117.

In addition, the handle 200 may be orientated, shown in dashed lines as positions 2 and 3, to allow a user to employ the most comfortable grip when grasping the same. As described above, the third portion 58 extends away from the centerline 117*a,* terminating in the second portion 56. The second portion 56 extends parallel to the centerline 117*a* and has the cross-member 46 attached thereto. This arrangement creates a force $F_{rot}$ that tends to urge rotation of the wand 117 about the centerline 117*a.* With the grip portion 250 extending transverse to the centerline 117*a,* and parallel to the pivot axis 62, the arm of the hand which grasps the grip portion 250 is positioned to move the nozzle laterally by bending at the elbow. This position allows a user to maximize the vertical distances reached by the brush applicator 112, but causes premature fatiguing of the arm due to having to overcome $F_{rot}$. To reduce the fatigue on a user's arm, the clamp 160 may be rotated, with respect to the centerline 117*a,* so that the grip portion 250 extends transverse to the pivot axis 62, shown in dashed lines as position 3. In this fashion, the arm of the hand grasping the grip portion 250 is orientated so that the elbow points downwardly, which is a more relaxed position and reduces premature fatigue. In addition, the grip portion may be rotated in direction, D, about second portion 252*b.* In this fashion, handle 200 provides three degrees of freedom of movement.

Finally, the diameter of either the wand 117, the handle 200 or both should be of a suitable size to allow a firm grasp of the same by the hand of a user. Although the diameter may be of any size, it is typically in the range of 0.75 to 1.20 inch. It was discovered, however, that a diameter measuring 1.10 inches was critical. The average size hand of a user exhibited less fatigue, for a given amount of time, when grasping the handle 200 or the wand 117 having a diameter approximating 1.10 inches.

Figure 14:
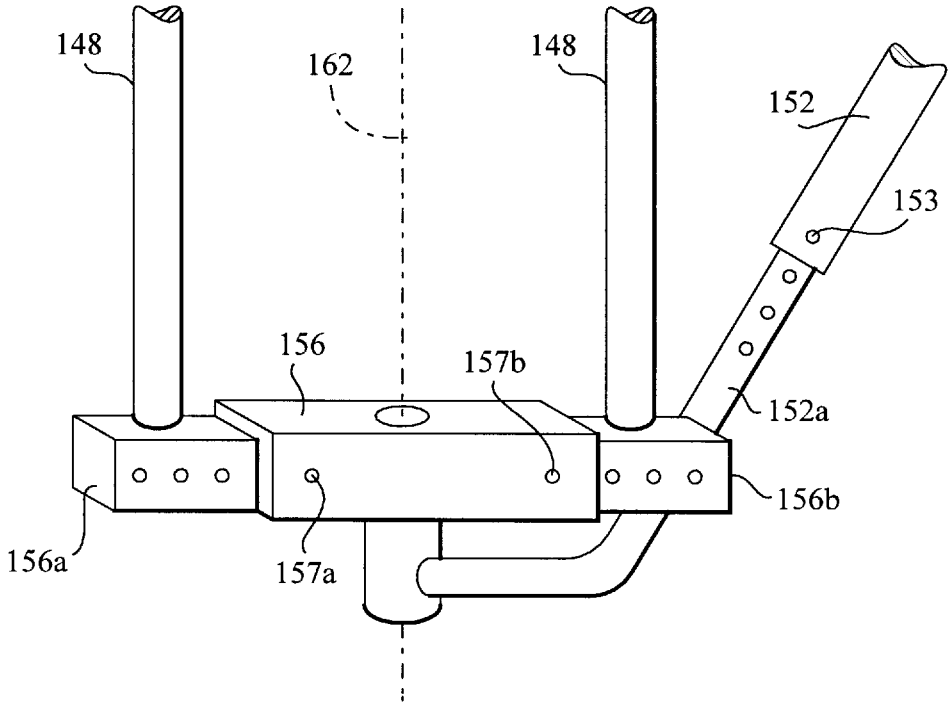
FIG. 14 is a perspective view of an alternate embodiment of the apparatus shown in FIG. 2.

Referring to FIG. 14, an alternative embodiment of frame and cross-member is shown. Although the spray-gun has been described with respect to using mini-roller-brushes, it should be understood that any size roller-brush may be employed. To that end, cross-member 156 includes two telescopic portions 156*a* and 156*b,* disposed on opposite sides of the pivot axis 162. Each of the telescopic portions 156*a* and 156*b* lock in place with pins 157*a* and 157*b,* respectively, allowing the shafts 148 to be displaced closer to, or further from, the pivot axis 162. Providing the spray-gun with an adjustable cross-member 156 allows employing roller-brush members 44 of differing sizes. This in turn allows differing nozzles to be employed to produce larger flow envelopes. The frame 152 may, therefore, include a telescopic portion 152*a* that locks in place with pin 153 to ensure that the minor axis of the ellipsis associated with the fluid envelope remains centered with respect to the nozzle.

I claim:

1. An applicator for applying fluid to a surface comprising, a spray-gun having a nozzle defining a flow path across which said fluid will travel;

a frame having a first and second end;

a connecting means, attached to said first end, for connecting said frame proximate to said nozzle;

a pair of spaced-apart roller-brush members, defining a target plane therebetween;

a cross-member pivotally connected to said second end, defining a pivot point, with each of said pair of spaced-apart roller-brush members rotatably attached to opposite ends of said cross-member; and means, connected to said frame, for selectively adjusting a maximum rotational movement of said cross-member, whereby said roller-brush members are prevented from entering said flow path.

2. The applicator as recited in claim 1 wherein said cross-member traverses an arcuate path, with said adjusting means including a detent mounted to said frame, said detent being spaced-apart from said pivot point a distance, said detent being slidably engaged with said frame and extending into said arcuate path, with said maximum rotational movement being proportional to said distance.

3. The applicator as recited in claim 2 wherein said detent includes a locking mechanism to selectively prohibit movement between said frame and said detent, thereby fixing said distance.

4. The applicator as recited in claim 1 wherein said frame comprises of a rod including first, second and third portions which extend parallel to a common plane, said first portion extending from said first end, terminating in said third portion and forming a first oblique angle therewith, with said third portion extending from said first portion, terminating in said second portion and forming a second oblique angle therewith, with both said pivot point and said adjusting means being located on said second portion.

5. The applicator as recited in claim 1 wherein a pair of shafts are perpendicularly disposed on each of said opposite ends of said cross member, said roller-brush members being disposed on said shafts, said cross-member having an adjustable length to vary a distance said shafts are disposed from said pivot point.

6. A fluid applicator comprising, a manifold body, including a fluid inlet and a fluid outlet and means for selectively placing said inlet and outlet in flow communication;

means, in fluid communication with said inlet, for remotely storing a fluid, with respect to said inlet, and transporting said fluid to said inlet under pressure;

a nozzle in fluid communication with said outlet, defining a flow path over which said fluid travels;

an elongated wand, extending along a longitudinal axis, between said nozzle and said outlet to remotely dispose said nozzle with respect to said manifold body;

an assembly removably attachable to said wand including a frame having a first and second end, a connecting means, attached to said first end, for attaching said frame to said wand, a cross-member pivotally connected to said second end, defining a pivot point, and a pair of spaced-apart roller-brush members rotatably attached to opposite ends of said cross-member; and means, connected to said frame, for selectively adjusting a maximum rotational movement of said cross-member, whereby said roller-brush members are prevented from entering said flow path.

7. The applicator as recited in claim 6 wherein said connecting means includes a clamp attached to selectively squeeze said wand, thereby allowing a distance between said roller-brush members and said nozzle to be varied.

8. The applicator as recited in claim 6 further including a handle attached to said wand, said handle including a grip portion, which extends along a centerline and a clamping device adapted to selectively squeeze said wand, thereby allowing said handle to be affixed to said wand at different positions along said longitudinal axis.

9. The applicator as recited in claim 8 wherein said grip portion is pivotally attached to said clamp means to rotate 360°.

10. The applicator as recited in claim 6 wherein said cross-member traverses an arcuate path, with said adjusting means including a detent mounted to said frame, spaced-apart from said pivot point a distance, said detent being slidably engaged with said frame and extending into said arcuate path, with said maximum rotational movement being proportional to said distance.

11. The applicator as recited in claim 10 wherein said detent includes a locking mechanism to selectively prohibit movement between said frame and said detent, thereby fixing said distance.

12. The applicator as recited in claim 6 wherein said wand includes an outer shielding having opposed termini and a flexible hose disposed therebetween.

13. The applicator as recited in claim 12 wherein said outer shielding includes a coupler disposed therein at each termini, with opposed ends of said flexible hose being affixed attached to one of the couplers.

14. The applicator as recited in claim 6 wherein said frame comprises of a rod including first, second and third portions which extend parallel to a common plane, said first portion extending from said first end, terminating in said third portion and forming a first oblique angle therewith, with said third portion extending from said first portion, terminating in said second portion and forming a second oblique angle therewith, with both said pivot point and said adjusting means being located on said second portion.

15. The applicator as recited in claim 6 wherein a pair of shafts are perpendicularly disposed on each of said opposite ends of said cross member, said roller-brush members being disposed on said shafts, said cross-member having an adjustable length to vary a distance said shafts are disposed from said pivot point.

16. A fluid applicator comprising, a manifold body, including a fluid inlet and a fluid outlet and means for selectively placing said inlet and outlet in flow communication;

a nozzle in fluid communication with said outlet, defining a flow path over which said fluid travels;

means, in fluid communication with said inlet, for remotely storing a fluid, with respect to said inlet, and transporting said fluid to said inlet under pressure;

an elongated wand, extending alone a longitudinal axis, between said nozzle and said outlet to remotely dispose said nozzle with respect to said manifold body;

an assembly removably attachable to said wand including a frame having a rod including first, second and third portions which extend parallel to a common plane, said first portion extending from a first end, terminating in said third portion and forming a first oblique angle therewith, with said third portion extending from said first portion, terminating in a second portion and forming a second oblique angle therewith, with a connecting means, attached to said first end, for attaching said frame to said wand, a cross-member pivotally connected to said second end, defining a pivot point, and a pair of spaced-apart roller-brush members rotatably attached to opposite ends of said cross-member;

a detent mounted to said second portion, spaced-apart from said pivot point a distance, said detent being slidably engaged with said second portion, with said cross-member adapted to traverse an arcuate path and said detent extending across said arcuate path, thereby limiting a maximum rotational movement of said cross-member, with said maximum rotational movement being proportional to said distance.

17. The applicator as recited in claim 16 wherein said connecting means includes a clamp attached to selectively squeeze said wand, thereby allowing a distance between said roller-brush members and said nozzle to be varied.

18. The applicator as recited in claim 16 further including a handle attached to said wand, said handle including a grip portion, which extends along a centerline and a clamping device adapted to selectively squeeze said wand, thereby allowing said handle to be affixed to said wand at different positions along said longitudinal axis, said grip portion being pivotally attached to said clamp means to rotate 360°.

19. The applicator as recited in claim 16 wherein said wand includes an outer shielding having opposed termini a flexible hose and a pair of couplers with each coupler being rigidly attached to said outer shielding at one of said opposed termini and flexible hose extending between, and rigidly attach to, said pair of couplers.

20. The applicator as recited in claim 16 wherein said detent includes a locking mechanism to selectively prohibit movement between said frame and said detent, thereby fixing said distance.

21. The applicator as recited in claim 16 wherein a pair of shafts are perpendicularly disposed on each of said opposite ends of said cross member, said roller-brush members being disposed on said shafts, said cross-member having an adjustable length to vary a distance said shafts are disposed from said pivot point.

* * * * *

UNITED STATES PATENT AND TRADEMARK OFFICE

CERTIFICATE OF CORRECTION

PATENT NO. : 5,829,905
DATED : November 3, 1998
INVENTOR(S) : Byron J. Woodruff

It is certified that error appears in the above-identified patent and that said Letters Patent is hereby corrected as shown below:

Title page, item [54] and col. 1, the title should read as followings: "TRAVEL LIMITER FOR A DYNAMICALLY PIVOTING MULTIPLE ROLLER-BRUSH SPRAY" should read - - TRAVEL LIMITER FOR A DYNAMICALLY PIVOTING MULTIPLE ROLLER-BRUSH SPRAY APPLICATOR - -.

Claim 18, col. 12, line 35, "extending alone" should read - - extending along - -.

Signed and Sealed this

Ninth Day of March, 1999

*Attest:*

Q. TODD DICKINSON

*Attesting Officer*

*Acting Commissioner of Patents and Trademarks*